US007549430B1

(12) United States Patent
Gravlee

(10) Patent No.: US 7,549,430 B1
(45) Date of Patent: Jun. 23, 2009

(54) SECURED UMBRELLA AND TABLE ASSEMBLY

(75) Inventor: John Gravlee, Bunnell, FL (US)

(73) Assignee: Furniture Leisure, Inc., Bunnell, FL (US)

( * ) Notice: Subject to any disclaimer, the term of this patent is extended or adjusted under 35 U.S.C. 154(b) by 0 days.

(21) Appl. No.: 11/675,411

(22) Filed: Feb. 15, 2007

(51) Int. Cl.
*A45B 3/00* (2006.01)
*A47B 37/04* (2006.01)

(52) U.S. Cl. ..... 135/16; 135/98; 108/50.12; 248/536; 248/74.4

(58) Field of Classification Search ..... 135/15.1, 135/16, 98; 108/50.11–50.13; 248/511–513, 248/536, 74.4; 403/344
See application file for complete search history.

(56) References Cited

U.S. PATENT DOCUMENTS 2,190,222 A * 2/1940 Strasser ..... 248/158
2,743,146 A * 4/1956 Wheeler ..... 108/50.12
2,799,543 A * 7/1957 Tomaselli ..... 108/50.12
3,167,292 A * 1/1965 Meyerowitz ..... 248/230.1
3,194,403 A * 7/1965 Van Horn, Jr. ..... 211/78
3,215,381 A * 11/1965 Ching ..... 248/167
4,116,572 A * 9/1978 Heldmann et al. ..... 403/7
4,318,567 A * 3/1982 Guthier ..... 297/184.16
4,353,659 A * 10/1982 Comte ..... 403/24
4,428,697 A * 1/1984 Ruland ..... 403/344
5,161,561 A 11/1992 Jamieson ..... 135/16
5,335,803 A * 8/1994 O'Brien et al. ..... 211/163
5,427,346 A * 6/1995 Urgola ..... 248/519
5,474,191 A * 12/1995 Bergeron et al. ..... 211/70.2
5,809,930 A * 9/1998 Brooks ..... 116/174
5,899,506 A * 5/1999 Tseeng ..... 285/148.23
5,934,634 A * 8/1999 Lindblom ..... 248/230.1
6,109,279 A * 8/2000 Kloss et al. ..... 135/16
6,554,012 B2 * 4/2003 Patarra ..... 135/16
6,668,750 B1 * 12/2003 Walz et al. ..... 116/173
6,702,245 B1 * 3/2004 Otterman ..... 248/536
7,155,860 B1 * 1/2007 Ferguson, III ..... 47/66.6

* cited by examiner

*Primary Examiner*—Winnie Yip
(74) *Attorney, Agent, or Firm*—Sanchelima & Assoc., P.A.

(57) ABSTRACT

A table and umbrella assembly capable of withstanding lateral forces by providing an overall center of gravity below its top. Two collar lock assemblies are removably mounted to a pole assembly that passes through the top center. The umbrella pole assembly, when tubular, may include a weight introduced to the lowermost member. The weight may be either solid or liquid and does not extend above the top.

4 Claims, 3 Drawing Sheets

SECURED UMBRELLA AND TABLE ASSEMBLY

BACKGROUND OF THE INVENTION

1. Field of the Invention

The present invention relates to a secured umbrella and table assembly, and more particularly, to such assemblies that are capable to withstand wind forces.

2. Description of the Related Art

Several designs for umbrellas with or without tables have been designed with the intent to withstand lateral and uplift forces, such as those produced by strong winds. None of them, however, have taken advantage of securing the umbrella to the table combining the sum of the weight and table size to further stabilize and lower the center of gravity of the resulting structure.

Applicant believes that the closest reference corresponds to U.S. Pat. No. 5,161,561 issued to Jamieson. This patent discloses the use if bearing 54 that is affixed to pole 12 but it requires the use of latch members 130 and 132. The resulting device has numerous parts and is quite complicated to install.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide an umbrella and table combination that is capable of resisting lateral forces such as wind forces.

It is another object of this invention to provide the means to combine the weight of an umbrella and table assembled together that is structurally stable with a low center of gravity.

It is yet another object of this invention to provide such a device that is inexpensive to manufacture, easy to install, and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
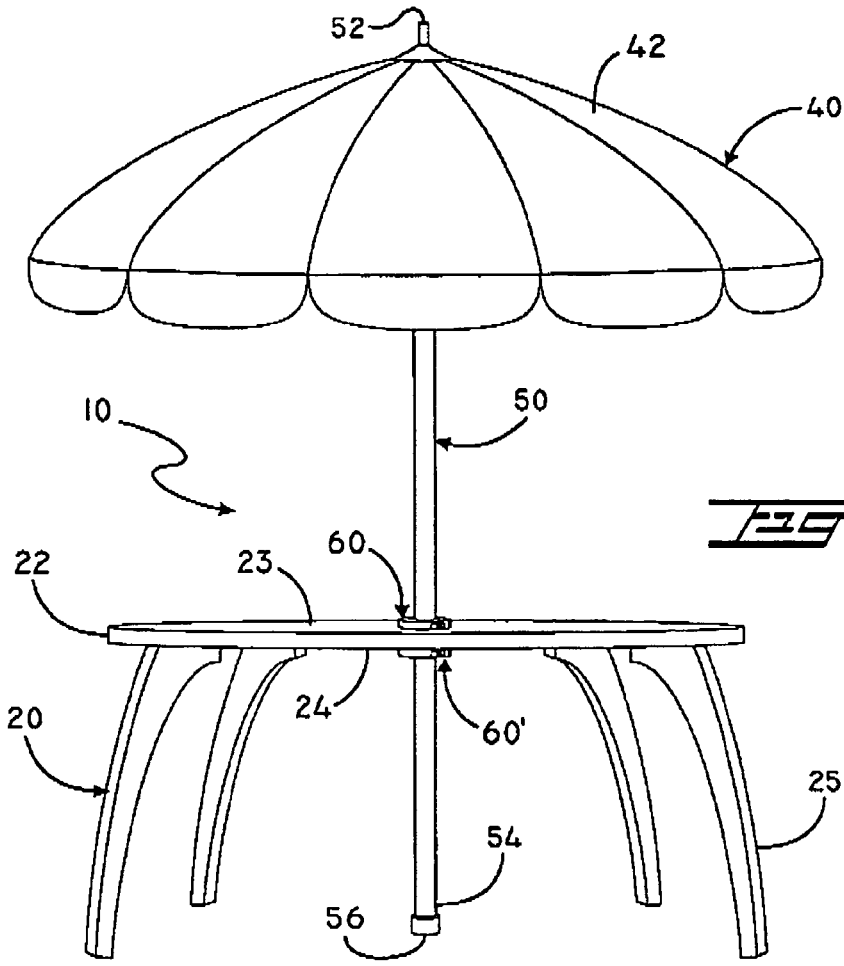
FIG. 1 represents an inclined elevational view of one of the preferred embodiments for the umbrella and table assembly subject of the present application.

Referring now to the drawings, where the present invention is generally referred to with numeral 10, it can be observed that it basically includes table assembly 20, umbrella assembly 40 including a pole assembly 50 and collar locking assemblies 60 and 60'. Assemblies 40 and 50 typically have a combined center of gravity that is higher than the center of gravity of table assembly 20. It has been found that the resulting umbrella and table assembly 10 is remarkably more stable because the center of gravity combination is lower than the center of gravity of assembly 40.

Figure 3:
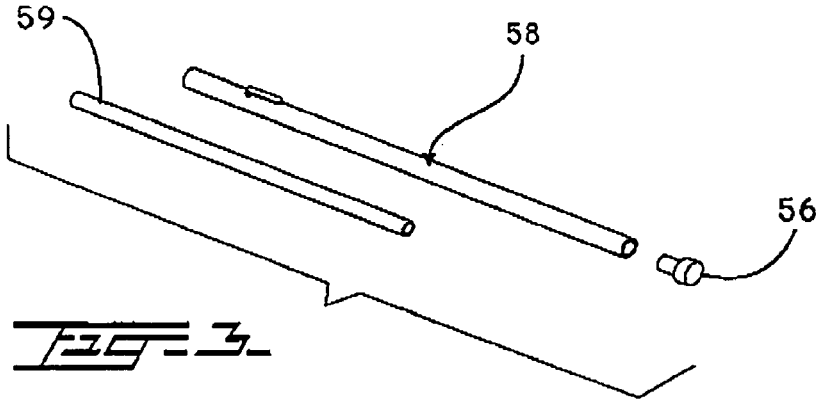
FIG. 3 is an isometric representation of the tubular pole with a cooperating tubular weight receivable within the former and a cap member
Figure 3A:
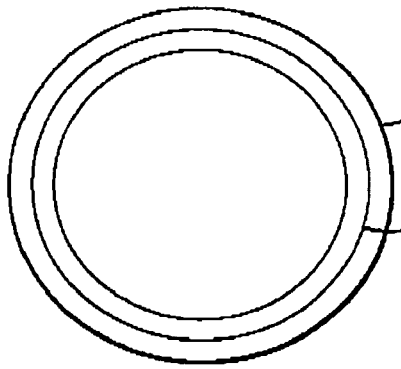
FIG. 3A illustrates a top view of the tubular member with the tubular weight coaxially housed therein.

As best seen in FIG. 1, table assembly 20 includes table top 22 which is substantially flat and includes upperside 23 and underside 24. Legs 25 keep top 22 at a separate and spaced apart relationship with respect to a supporting plane (not shown). Umbrella assembly 40 includes parasol 42 mounted at one end 52 of pole assembly 50 and the other end 54 resting off a supporting plane. Cap member 56 is optionally used to keep extraneous material and animals from entering pole assembly 50. Pole assembly 50 includes tubular member 58 that coaxially and removably receives elongated weight member 59 therein as best seen in FIGS. 3 and 3*a*. Weight member 59 extends from end 54 and does not extend beyond top 22.

Figure 2:
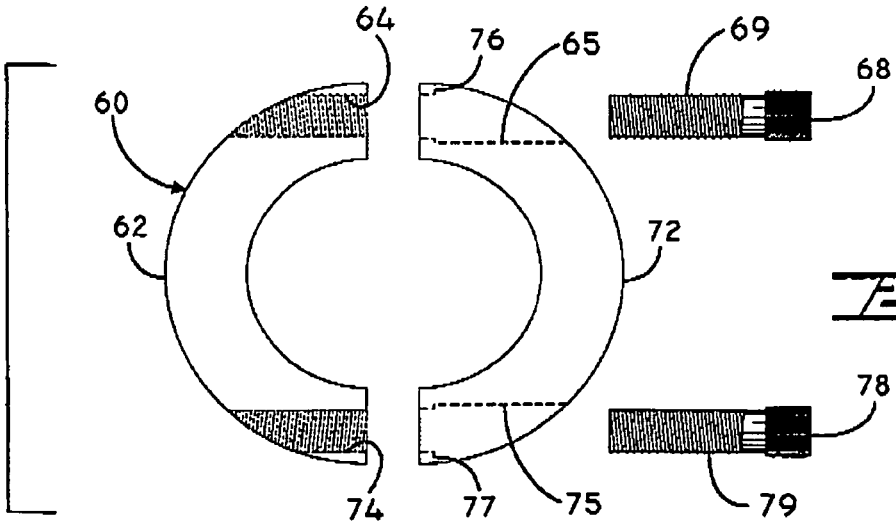
FIG. 2 shows a top view of one of the locking collar assemblies used in one of the preferred embodiments.

Locking collar assemblies 60 and 60' are identical. Assembly 60 includes, in the preferred embodiments, two complementary half rings 62 and 72 that, when brought together, form a circle as shown in FIG. 2. Half ring 62 includes threaded bores 64 and 74 positioned internally through sections of half ring 62. Half ring 72 includes bores 65 and 75 in cooperative and coaxial alignment with bores 64 and 65 when brought in abutting relationship, a cooperate to permit threaded bolts 69 and 79 to pass through. Bolts 69 and 79 include a flanged heads 68 and 78, respectively, that coact with counterbores 76 and 77, respectively, to firmly engage half-rings 62 and 72 together embracing tubular member 58. Collar assembly 60 is mounted above, and abutting to, top 22 whereas assembly 60' is mounted below, and abutting to, top 22. This results in a unitary assembly with an effective center of gravity below top 22.

Figure 2A:
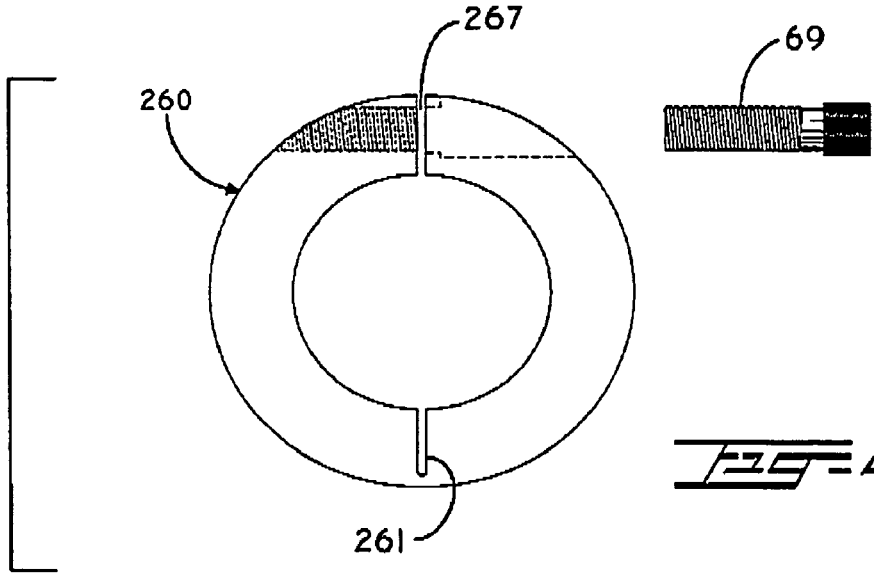
FIG. 2A illustrates a top view of an alternate design for the locking collar assembly.

Another embodiment for the collar assemblies is shown in FIG. 2*a* as assembly 260, which is basically a ring with a transversal cut 267 and partial cut 261. Transversal cut 267 has a clearance that permits the tightening of collar assembly 260 for rigidly mounting it to pole assembly 50. Partial cut 261 is intended to provide some flexibility to ring assembly 260.

Figure 4:
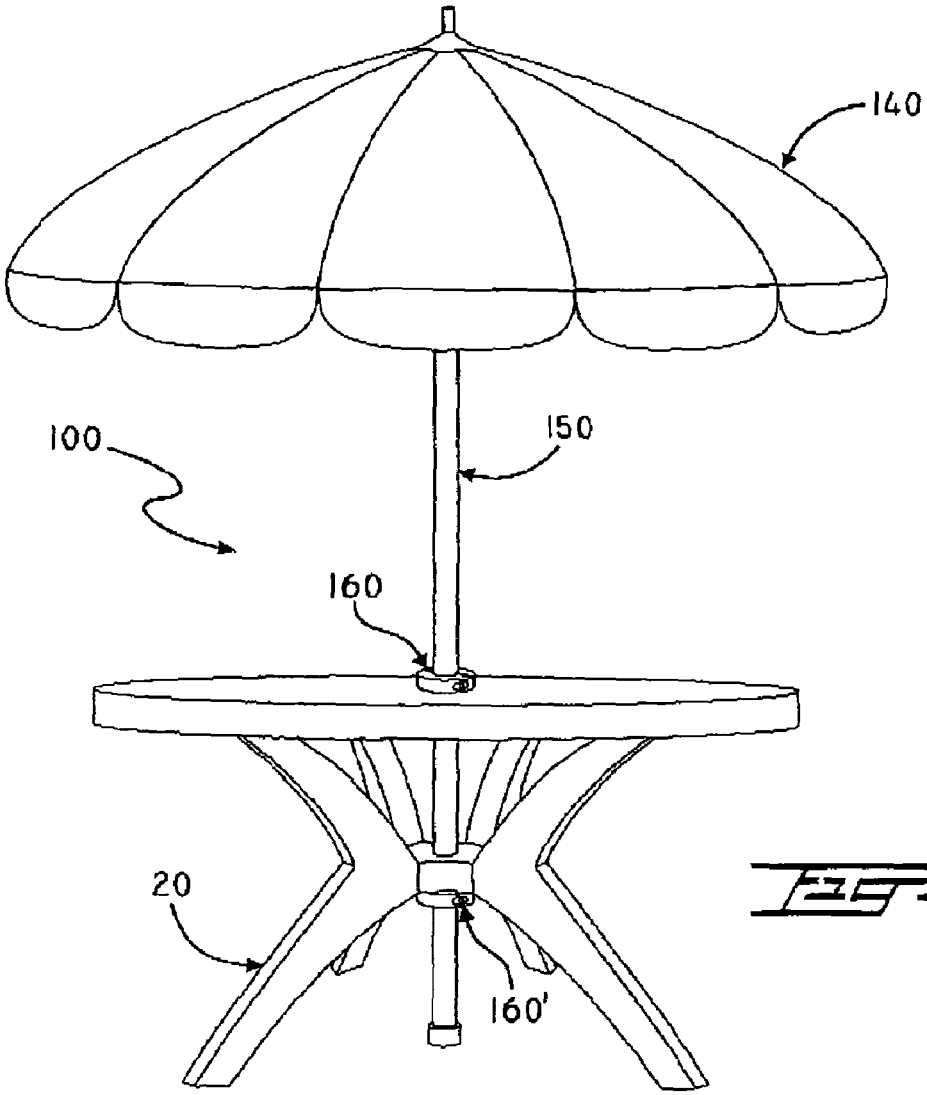
FIG. 4 represents an inclined elevational view of another design of a table assembly with the locking collar assemblies mounted substantially separate from each other.

In FIG. 4, an alternative embodiment 100 is shown where locking collar assembly 160' is mounted farther remote from collar assembly 160 because of the design of table assembly 120. However, the effect is the same. The combination center of gravity of umbrella assembly 140 and pole assembly 150 is typically higher than the center of gravity of table assembly 120. So, when locked together, the center of gravity of the umbrella and pole assemblies is lowered resulting in a more stable structure.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A table and umbrella assembly, comprising:

A) a table assembly including a top and at least three legs for keeping said top at a parallel and spaced apart relationship from a supporting horizontal surface, said top having a central through opening;

B) an umbrella assembly having an elongated pole assembly passing through said through opening and further including first and second ends, and a parasol assembly mounted to said first end, and said pole assembly includes a tubular member having a first predetermined inner diameter and an elongated weight member of a second predetermined diameter smaller than said first predetermined diameter, and said weight member being receivable within said tubular member and extending below said top; and C) first and second locking collar assemblies removably and rigidly mounted to said pole assembly above and below said top to abuttingly sandwich said top thereby resulting in a unitary structure with its center of gravity below said top and capable of withstanding lateral forces of a predetermined magnitude.

2. The assembly set forth in claim 1 wherein said pole assembly includes a cap member removably mounted to said second end so that weight means can be introduced therethrough and housed therein thereby further lowering the center of gravity of said pole assembly.

3. The assembly set forth in claim 2 wherein said first and second locking collar assemblies include, each, first and second complementary half rings each of said half rings includes first and second ring ends that are brought in abutting contact when mounted to said pole assembly, said first and second ring ends of said first complementary half rings including through cavities and said first and second ring ends of said second complementary half rings including a threaded opening, and further including fastening means cooperatively received through said through cavities thereby firmly and removably securing said first and second locking collar assemblies to said pole assembly.

4. The assembly set forth in claim 2 wherein said first and second locking collar assemblies include, each, a ring member with a transversal cut and a cooperating through cavity and threaded opening aligned at said transversal cut, and further including a partial cut substantially opposite to said transversal cut so that sufficient flexibility is provided, and further including fastening means cooperatively received through said through cavity and threaded opening thereby firmly and removably securing first and second locking collar assemblies to said pole assembly.

* * * * *